US007011539B1

(12) United States Patent
Nagy et al.

(10) Patent No.: US 7,011,539 B1
(45) Date of Patent: Mar. 14, 2006

(54) SEAL FOR AN ELECTRICAL CONNECTOR

(75) Inventors: Brian Nagy, Woodhaven, MI (US); Joseph Mauney, South Lyon, MI (US); David Houck, Dearborn, MI (US)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/250,081

(22) Filed: Oct. 13, 2005

(51) Int. Cl.
*H01R 13/52* (2006.01)

(52) U.S. Cl. ..... 439/271

(58) Field of Classification Search ..... 439/271, 439/272, 587
See application file for complete search history.

(56) References Cited

U.S. PATENT DOCUMENTS 4,820,181 A * 4/1989 Kuzuno et al. ..... 439/272
5,779,493 A * 7/1998 Tomita et al. ..... 439/271
5,927,725 A 7/1999 Tabata et al.
6,517,368 B1 * 2/2003 Hara et al. ..... 439/271
6,814,599 B1 * 11/2004 Sakiyama et al. ..... 439/271
6,953,357 B1 * 10/2005 Fukushima et al. ..... 439/271

FOREIGN PATENT DOCUMENTS

JP 6-46067 11/1994
JP 2524949 8/1996
JP 2002-134219 5/2002

* cited by examiner

*Primary Examiner*—Tho D. Ta
(74) *Attorney, Agent, or Firm*—Gerald E. Hespos; Anthony J. Casella

(57) ABSTRACT

A connector (10) has a body (12) with an outwardly projecting flange spaced rearward from the front end (14) of the body (12). Wide mounting slots (36) extend through the flange (32). A seal (40) has a frame-shaped body (42) mounted over the front end (14) of the body (12) and against the flange (32). Attachment tabs (60) project back from the frame-shaped body (32) and through the mounting slots (36). The attachment tabs (60) have a length greater than their width and a width greater than their thickness. Portions of the attachment tabs (60) rearward of the attachment tabs (60) rearward of and adjacent to the flange (32) are wide than the mounting slots (36) for holding the seal (60) on the housing (12).

19 Claims, 4 Drawing Sheets

SEAL FOR AN ELECTRICAL CONNECTOR

BACKGROUND OF THE INVENTION

1. Field of the Invention

The invention relates to a waterproofing seal for use with an electrical connector.

2. Description of the Related Art

An electrical connector assembly includes first and second connectors that are configured to mate with one another. Each connector typically has a housing and at least one cavity extends through the housing. Each cavity is configured to receive a terminal fitting. One end of each terminal fitting typically is connected to a conductor, such as the wire, cable, busbar, an electrical device or a conductive region of a circuit board. The opposed end of each terminal fitting is configured for achieving electrical connection with a terminal fitting in the mating connector.

Many connectors, such as those used in automotive vehicles, will be exposed at least periodically to moisture. The housing of an electrical connector typically is formed from a resin or other material that can withstand periodic exposure to moisture. However, moisture can adversely affect the metallic terminal fittings and can cause a shorting between two terminal fittings. A short circuit can have serious effects on critical components of a vehicle, such as warning lights, airbags and the like.

Many connectors include an elastomeric seal to prevent intrusion of moisture into the region of the connector that contains the terminal fittings and the conductors to which the terminal fittings are connected. A seal of this type typically is mounted at an area where two parts of the mating housings will telescope together. For example, a frame-shaped seal or a toroid-shaped seal may be mounted over one housing of a connector assembly. The end of the mating housing will abut against the seal when the housings are connected. Thus, the seal engages the interface between the two housings to provide sealing.

An electrical connector typically is assembled at one location and then transported to another location for connection with a mating connector. For example, an electrical connector may be mounted to an end of a wiring harness assembled at a manufacturing facility of an electrical component supplier. The wiring harness then may be shipped to an automobile manufacturer for connection with electrical equipment that is assembled into the vehicle. The seals in such connectors must be mounted in a way that will prevent separation during transit.

Connectors must be designed to accommodate periodic disconnection for maintenance, repair or replacement. Forces generated during such disconnection can urge a seal in a direction to displace the seal from its properly mounted position. The seal might be mounted improperly when the connectors are reconnected to one another.

In view of the above, the seal of an electrical connector must be mounted in a way that will prevent separation during transit and that will prevent movement during a disconnection of a connector assembly.

The housing of an electrical connector generally is formed from a rigid material such as a synthetic resin. The seal, on the other hand, generally is formed from an elastomeric material, such as rubber. The elastomeric frame-shaped seal may be expanded slightly to telescope over one of the housings to be sealed. Connectors continue to be made smaller in response to the demands of purchasers of such connectors. As a result, the frame-shaped elastomeric seals generally are small and must be assembled to a small housing. The small sizes of electrical connectors complicate the assembly of the seal to the housing.

Prior art electrical connectors have used three different approaches for retaining a seal on the housing. The first approach relies merely on the friction between the expanded elastomeric material of the seal and the rigid resin of the housing. However, the seal can be disengaged or repositioned during transit or during a disconnection of two housings, thereby creating the potential for improper sealing during a connection or reconnection.

The second approach employs a separate cover formed from a rigid material and mounted to the housing after the seal has been positioned. The rigid cover can be locked mechanically to the housing and ensures that the seal remains in place during transit. The separate cover works very well for assuring the position of the seal. However, the cover adds to the dimensions of the connector and hence impedes efforts to reduce the size of a connector. Additionally, the separate cover imposes a cost penalty in terms of material costs, inventory control and assembly costs. In this regard, the electrical connector industry is highly competitive and even small cost savings can be commercially very advantageous.

The third approach employs an elastomeric seal with projections. The housing then is formed with apertures for receiving the projections. The seal is manipulated so that the projections on the seal engage in the apertures on the housing to hold the seal in place. A properly mounted seal of this type also works well. However, prior art connectors of this type have entailed complicated assembly, particularly in view of the decreasing sizes of the connectors. In particular, the projections on the known elastomeric seal have been difficult to mount properly in the openings on the housing. Accordingly, assembly often has required the use of a screwdriver-like tool. The tool can damage the housing in a way that could lead to the intrusion of the water that is intended to be avoided by the seal. In other instances, the tool can separate plastic debris from the housing. The debris can remain in the housing and can affect the performance of the connector.

In view of the above, it is an object of the subject invention to provide a seal that can be mounted efficiently to a housing of a connector.

Another object of the invention is to provide a seal that can be mounted without the use of a mounting tool.

SUMMARY OF THE INVENTION

The invention relates to a seal for an electrical connector. The connector includes a housing formed from a resin material that is more rigid than the material of the seal. The housing has opposite front and rear ends and terminal fittings are mounted in the housing. The terminal fittings can be connected electrically with mating terminal fittings in a mating housing by moving the housings towards one another in a front-to-rear direction.

A flange extends out from a peripheral wall of the housing and is aligned substantially transverse to the front-to-rear direction. Mounting slots extend through the flange. Each mounting slot has a width dimension extending in the plane of the flange and aligned parallel to the adjacent peripheral wall of the housing. Each mounting slot also has a height dimension extending in the plane of the flange and aligned substantially normal to the adjacent peripheral wall of the housing. The width dimension of each slot preferably is greater than the height dimension, and most preferably several times greater than the height dimension.

A seal hood may extend forward from the outer extreme of the flange. Thus, the seal hood is substantially parallel to and spaced from the peripheral wall of the housing.

The seal preferably is formed unitarily from an elastomeric material and defines a frame shape or toroid shape. More particularly, the seal has an inner peripheral surface that is dimensioned and configured for mounting over and sealing against the outer peripheral walls of the housing. The seal also has an outer peripheral surface that may be dimensioned and configured for engaging the inner surface of the seal hood. A thickness of the frame-shaped body is measured between the inner and outer peripheral surfaces.

The seal further includes opposite front and rear surfaces that extend between the inner and outer peripheral surfaces. The front surface faces forwardly on the housing and is configured for sealing engagement with a front portion of the mating housing. For example, the front surface of the seal may include a groove for receiving a front edge of the mating housing.

The rear surface of the seal is characterized by attachment tabs aligned respectively with the mounting slots in the flange. Each attachment tab has a thickness dimension measured in a direction extending parallel to the thickness direction of the frame-shaped body of the seal. The thickness of the tab preferably does not exceed the thickness of the frame-shaped body. Each attachment tab also has a width dimension measured substantially normal to the thickness dimension. The width dimension of each attachment tab exceeds the thickness dimension thereof. Each attachment tab also has a length extending substantially normal to the plane of the front and rear surfaces of the seal. The length of each attachment tab preferably is greater than the width of the attachment tab.

Each attachment tab has a neck adjacent the rear surface of the frame-shaped body of the seal and a head that extends rearwardly from the neck. The neck has thickness and width dimensions substantially corresponding to the height and width dimensions of the corresponding mounting slot. Additionally, the neck has a length substantially equal to the thickness of the flange. A portion of the head substantially adjacent the neck is cross-sectionally larger than both the neck and the mounting slot. However, the head tapers gradually to a cross-section that is smaller than both the neck and the mounting slot. The tapering of the head in the width direction preferably exceeds the tapering of the head in the thickness direction. The head defines a length measured normal to the front and rear surfaces of the fame-shaped body of the seal that is several times greater than the length of the neck.

The seal is mounted to the housing by urging the rear surface of the seal rearwardly over the front end of the housing with the attachment tabs substantially aligned with the respective mounting slots in the flange. The cross-sectionally small rear end of the head of each attachment tab will easily enter the cross-sectionally larger mounting slot. The head of each attachment tab becomes cross-sectional larger at locations closer to the neck, and at least the width dimension will exceed the corresponding cross-sectional dimensions of the mounting slot when the rear surface of the seal approaches the flange. As a result, the large forward end of the head of the attachment tab will compress resiliently so that the head can pass through the mounting slot. The head will return resiliently to an undeformed condition as the neck enters the mounting slot. As a result, the head will hold the seal adjacent the flange.

The long tapered shape of the head of the attachment tab ensures that the attachment tab can be aligned properly with the associated mounting slot and urged a major portion of the distance through the mounting slot without being deformed resiliently. The portion of each attachment tab that is cross-sectionally larger than the mounting slot will contact the periphery of the mounting slot only when the seal is approaching the completely mounted position. As a result, the attachment tab will not be able to deflect in a way that will impede proper mounting. Thus, the mere rearward movement of the seal will achieve a secure and proper mounting. Tools are not necessary, and hence there is no chance of generating potentially harmful resin debris that could enter the housing. Additionally, the seal is held securely in place without a separate cover. Hence costs are lower and assembling labor is simplified.

DETAILED DESCRIPTION OF THE PREFERRED EMBODIMENT

Figure 1:
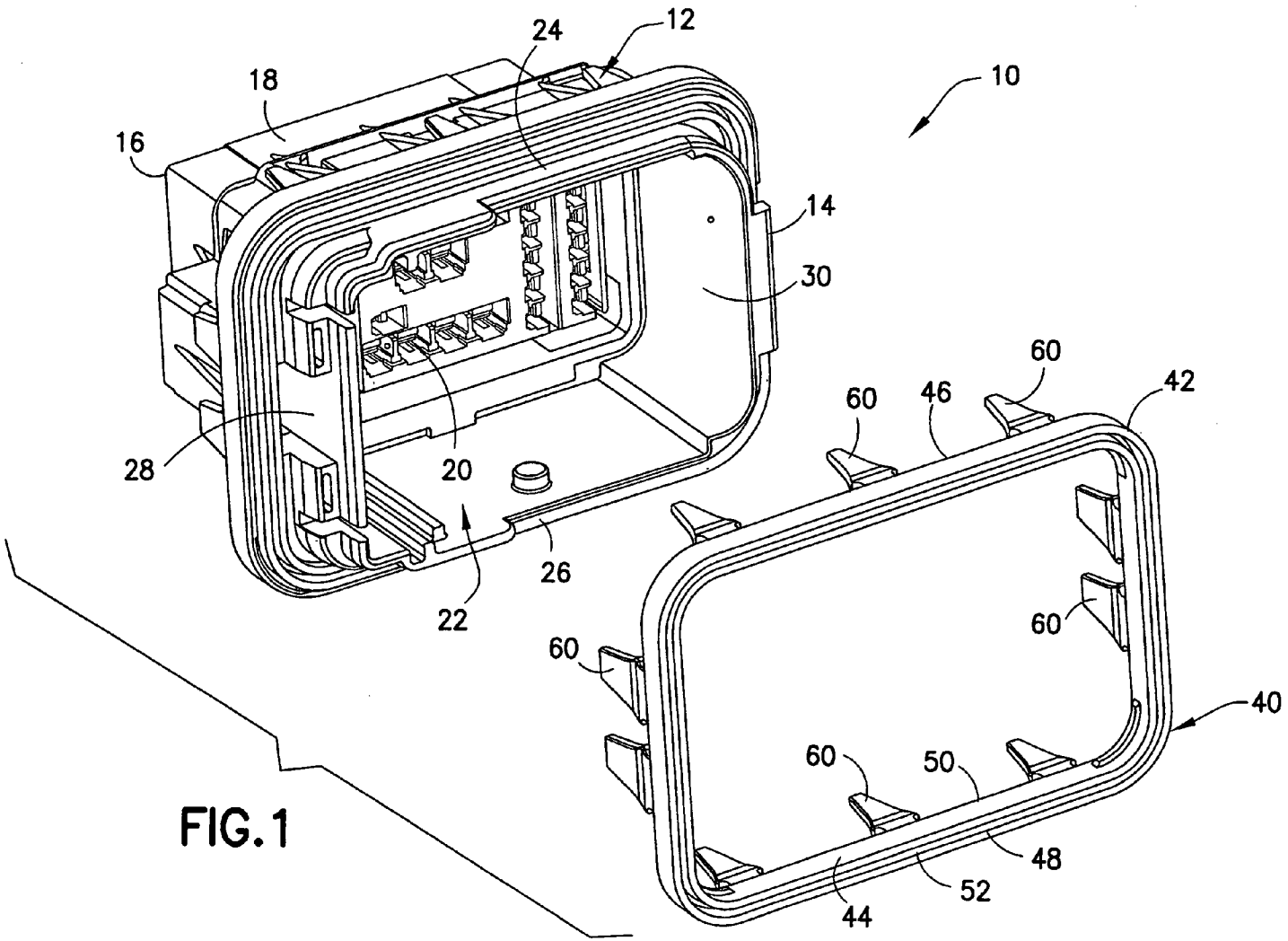
FIG. 1 is an exploded perspective view of a connector housing and seal in accordance with the invention.
Figure 2:
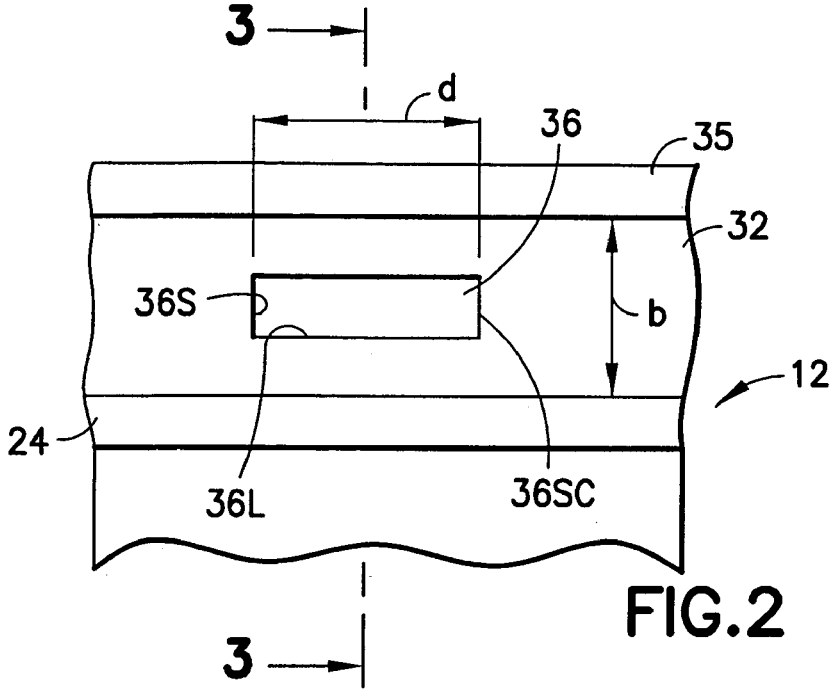
FIG. 2 is a front elevational view of a portion of the housing.
Figure 3:
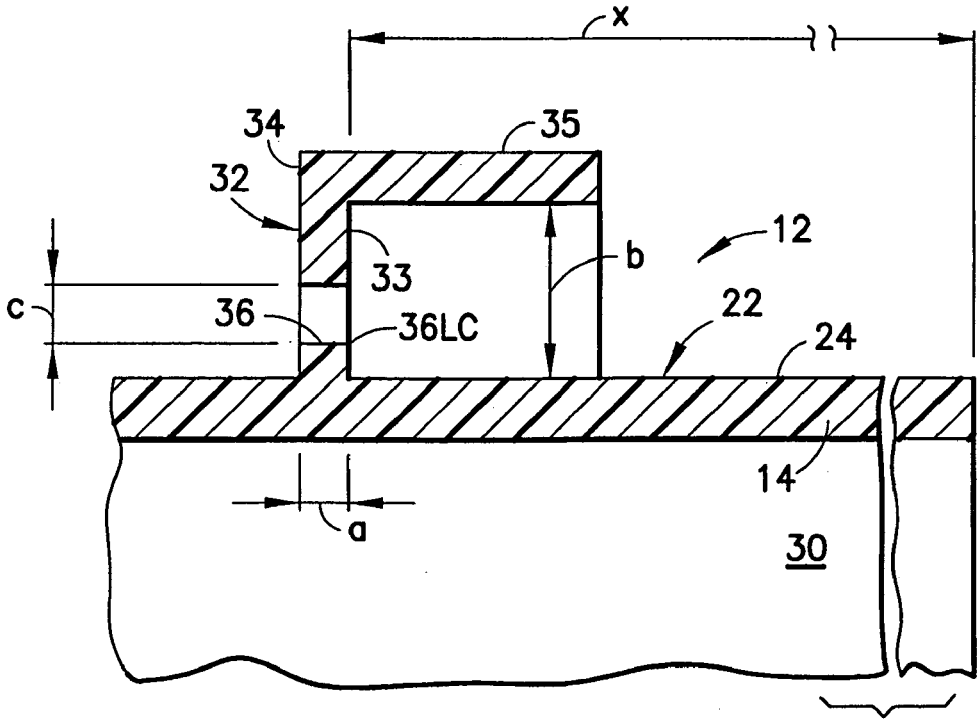
FIG. 3 is a cross-sectional view taken along line 3—3 in FIG. 2.
Figure 6:
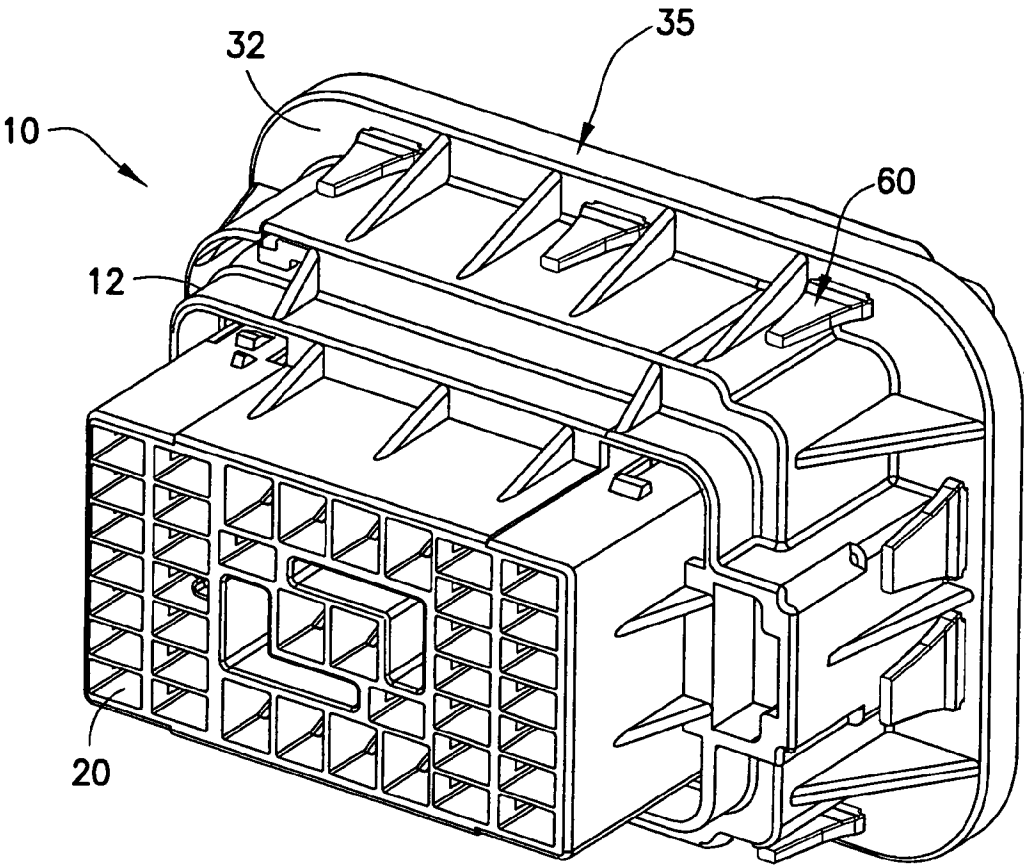
FIG. 6 is a perspective view of the seal properly mounted to the housing.

A connector in accordance with the invention is identified generally by the numeral 10 in FIGS. 1 and 6. The connector 10 includes a housing 12 that is shown in FIGS. 1 through 3 and 6. The housing 12 is molded unitarily from a synthetic resin and has opposite front and rear ends 14 and 16. A generally block shaped main body 18 extends forward from the rear end 16 and cavities 20 extend through the main body 18 in a rear-to-front direction. Terminal fittings (not shown) can be inserted into the respective cavities in a rear-to-front direction.

A rectangular tubular receptacle 22 extends from the main body 18 to the front end 14 of the housing 12. The receptacle 22 includes opposed substantially parallel top and bottom walls 24 and 26. The terms top and bottom are used in this description as a convenient frame of reference and are not intended to imply a required gravitational orientation. The receptacle 22 also includes opposed substantially parallel side walls 28 and 30 that are connected to the top and bottom walls 24 and 26 at rounded corners. The receptacle 22 is configured for receiving a mating connector (not shown). Thus, terminal fittings in the mating connector will connect electrically with terminal fittings in the cavities 20.

A substantially planar flange 32 extends substantially perpendicularly out from the outer periphery of the receptacle 22 at a location spaced rearward from the front end 14 of the housing 12 by a selected distance "x". The flange 32 has opposite front and rear surfaces 33 and 34 defining a thickness "a" measured in a front to rear direction. A seal hood 35 projects forward from the outer extreme of the flange 32 and is spaced from the outer periphery of the receptacle 22 by a distance "b".

Mounting slots 36 extend entirely through the flange 32 from the front surface 33 to the rear surface 34. Each mounting slot 36 is substantially rectangular and has opposite short inner surfaces 36S that are aligned substantially normal to the nearest wall 24, 26, 28 or 30 of the receptacle 22, substantially normal to the nearest surface of the seal hood 35 and substantially parallel to the projecting direction of the flange 32 from the receptacle 22. Each mounting slot 36 also has opposite long inner surfaces 36L that extend perpendicularly between the short inner surfaces 36S. The mounting slots 36 are spaced approximately equal distances from the outer peripheral surface of the receptacle 22 and the seal hood 35. The short inner surfaces 36S each define a height or minor dimension "c" for the mounting slot 36 measured in the plane of the flange 32 and substantially normal to the nearest wall 24, 26, 28 or 30 of the receptacle 22. The height "c" of each mounting slot 36 preferably is slightly less than the thickness "a" of the flange 32 and is approximately one-half the height "b" of the flange 32. The long inner surfaces 36L define a width or major dimension "d" for the mounting slot 36 measured in the plane of the flange 32 and substantially parallel to the nearest wall 24, 26, 28 or 30 of the flange 32. The width or major dimension "d" of each mounting slot 36 is several times greater than the height or minor dimension "c" of the mounting slot 36 and several times greater than the thickness "a" of the flange 32. Preferably, the ratio of the width "d" of the mounting slot 36 to the height "c" of the mounting slot 36 is about 3:1.

The connector 10 further includes a seal 40. The seal 40 is formed unitarily from an elastomeric material and includes a generally rectangular frame-shaped body 42 with opposite inner and outer peripheral surfaces 44 and 46 defining a thickness "t". Opposite front and rear surfaces 48 and 50 extend between the inner and outer peripheral surfaces 44 and 46. The seal 40 is dimensioned to mount over the front end 14 of the housing 12. In its properly mounted position, the inner peripheral surface 44 of the frame-shaped body 42 will sealingly engage the outer peripheral surface of the receptacle 22 forward of the flange 32. Additionally, the outer peripheral surface 46 of the frame shaped body 42 of the seal 40 will sealingly engage the inner surface of the seal hood 35. Furthermore, the rear surface 50 of the frame-shaped body 42 of the seal 40 will sealingly engage the front face 33 of the flange 32. Thus, the seal 40 is engaged resiliently between the outer peripheral surface of the receptacle 22 and the inner surface of the seal hood 35, and the flange 32 defines the proper position for the seal 40 in a front to rear direction. A groove 52 is formed in the front surface 48 of the frame shaped body 42 of the seal 40 and is configured for receiving the front end of the mating connector housing (not shown).

Figure 4:
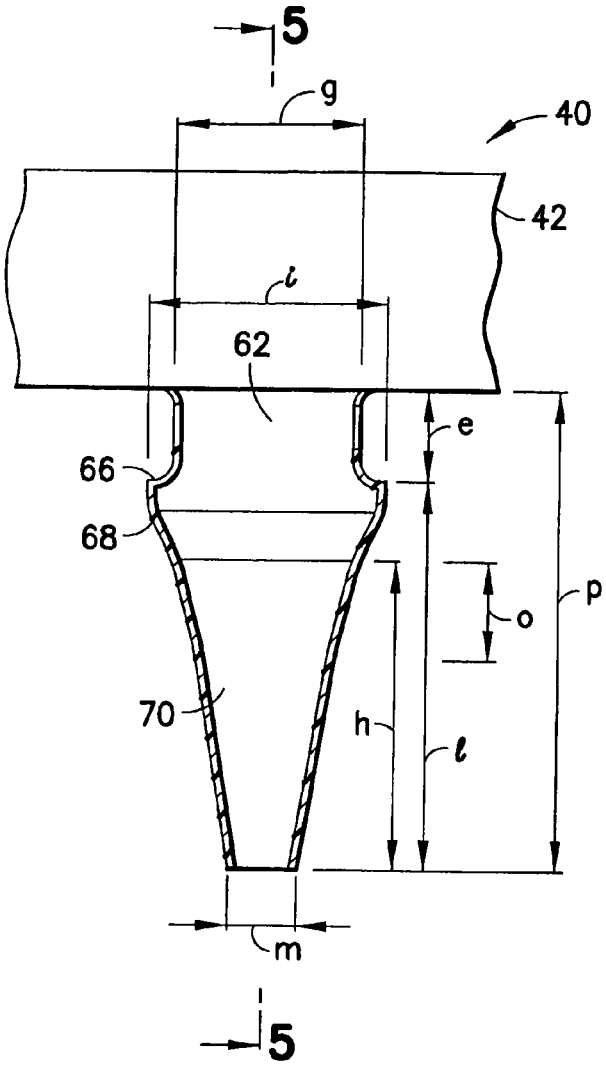
FIG. 4 is a top plan view of a portion of the seal.
Figure 5:
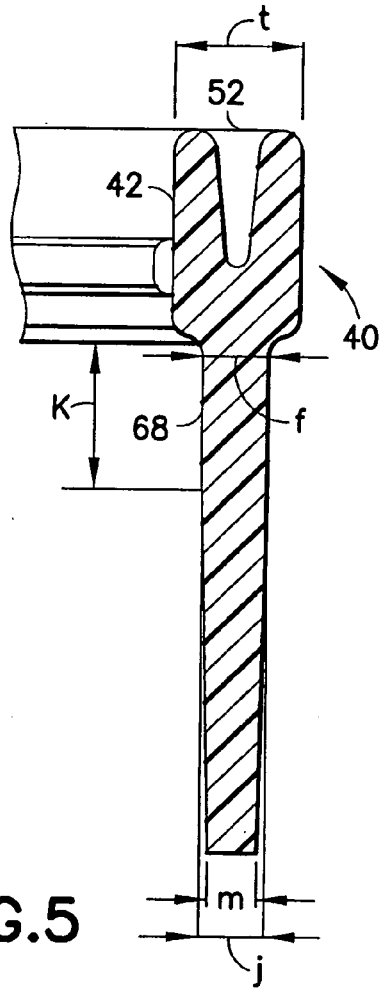
FIG. 5 is a cross-sectional view taken along line 5—5 in FIG. 4.

Attachment tabs 60 project rearward from the rear surface 50 of the frame shaped body 42 of the seal 40 at positions to align respectively with the mounting slots 36 of the flange 32. Each attachment tab 60 has a neck 62 adjacent the frame shaped body 42 of the seal 40 and a head 64 that projects rearward from the neck 62. Each neck 62 has a length "e" measured normal to the plane of the rear surface of the frame shaped body 42 of the seal 40, as shown in FIG. 4. The length "e" of the neck 62 is approximately equal to or slightly less than the thickness "a" of the flange 32. Additionally, each neck 62 has a thickness or minor dimension "f" (FIG. 5) and a width or major dimension "g" (FIG. 4) substantially corresponding to the height and width "c" and "d" of the associated mounting slot 36. Thus, the thickness "f" of the neck 62 is less than the thickness "t" between the inner and outer peripheral surfaces 44 and 46 of the frame-shaped body 42, as shown in FIG. 4.

The head 64 of each attachment tab 60 projects rearward from the respective neck 62 for a distance "h" that is several times greater than the length "e" of the neck 62, and preferably about five times greater, as shown in FIG. 4. The head 64 has a diverging section 66 that is adjacent the neck 62 and diverges laterally out at an angle of about 60° to a width dimension "i" that exceeds the width dimensions "d" of the mounting slot 36. The diverging section 66 does not diverge significantly in the height direction, and has a thickness "j" that approximately equals the thickness "f" of the neck 62. The head 64 has a holding section 68 that continues rearward from the diverging section 66 approximately at the width and height dimensions "i" and "j" for a distance "k" selected to provide sufficient attachment forces with the flange 32, as explained herein. The thickness "j" of the holding section is less than the thickness "t" between the inner and outer peripheral surfaces 44 and 46 of the frame shaped body 42. The head 64 also has a converging section 70 that continues rearward from the holding section 68 to the rear end of the attachment tab 60. The converging section 70 defines a length "l" several times greater than the length "e" of the neck 62 and tapers to minimum height and width dimensions "m" and "n" that are less than the height and width "c" and "d" of the corresponding mounting slot 36. The converging section 70 tapers from the maximum width adjacent the holding section 68 to a width substantially corresponding to the width "d" mounting slot 36 at a distance "o" from the holding section 68. The distance "o" is approximately equal to the length "e" of the neck 62. The tapering of the converging section 70 in the width direction is significantly greater than the tapering in the height direction. The overall length "p" of the attachment tab 60 from the rear surface of the frame-shaped body 42 to the tapered rear end of the converging section 70 is preferably greater than the distance "x" between the front end 14 of the housing 12 and the flange 32.

The seal 40 is mounted in a front to rear direction over the front end 14 of the housing 12 so that the rear surface 48 of the frame-shaped body 42 faces rearwardly. The frame-shaped body 42 is dimensioned for resiliently engaging the outer periphery of the receptacle 22. The attachment tabs 60 are disposed to align respectively with the mounting slots 36. As a result, the cross-sectionally small rear end of the converging section 70 of each attachment tab 60 enters the respective mounting slot 36 as the frame-shaped body 42 is mounted on front end 14 of the housing 12. The attachment tab 60 does not taper as significantly in the height direction as in the width direction, and the maximum height of the head 64 of the attachment tab 60 is approximately equal to the height of the mounting slot 36. As a result, the long corners 36LC defined by the intersection of the front surface of the flange 32 and the long inner surface 36L of the mounting slot 36 will not exert bending forces on the head 64 of the attachment tab 60. However, the attachment tabs 60 taper significantly in the width direction. As a result, the opposite side edges of the of the head 64 near the large front of the converging section 70 contact the short corners 36SC defined by the front surface of the flange 32 and the short inner surface 36S of the respective mounting slot 36. This contact applies forces substantially symmetrically to the opposite sides of the converging section 70 and deforms the opposite sides of the converging section 70 substantially in and rearward toward the frame shaped body 42. These forces do not bend the attachment tab 60 laterally because the symmetry of the attachment tab 60 results in balanced forces and because the relatively large width dimension "g" of the neck 62 resists bending.

The holding section 68 of the head 64 passes through the mounting slot 36 after sufficient mounting of the seal 40 onto the housing 12. As a result, the holding section 68 returns resiliently to an undeformed condition to engage the rear surface of the flange 32. Simultaneously, the rear surface 50 of the frame shaped body 42 abuts the front surface 33 of the flange 32, and the outer peripheral surface 46 of the frame shaped body 42 abuts the inner surface of the seal hood 35. Thus, the holding sections 68 hold the seal 40 in a proper sealing position on the housing 12.

The seal 40 can be mounted on the housing 12 without using a tool, and hence there is no possibility that the housing 12 will be damaged by the seal mounting process.

The seal 40 is held on the housing 12 by the engagement of the holding sections 68 of the attachment tabs 60 with the rear surface 34 of the flange 32. A separate cover is unnecessary. Therefore, the cost and additional labor associated with the separate cover of the prior art are avoided.

The attachment tabs 60 have height dimensions "j" that are small, and the heads 64 of the attachment tabs 60 do not extend transversely out beyond the outer peripheral surface 46 of the frame shaped body 42. Thus, the seal 40 does not increase the cross-sectional size of the connector 10.

The necks 62 of the attachments tabs 60 have short lengths "e" corresponding merely to the thickness "a" of the flange 32 on the housing 12. As a result, the cross-sectionally small necks 62 are not likely to buckle during mounting.

The long tapered converging sections 70 of the attachment tabs 60 guide the attachment tabs 60 into the mounting slots 36 at an early stage of mounting the seal 40 on the housing 12.

The diverging sections 66 of the attachment tabs 60 do not diverge in the height direction. As a result, bending forces are not applied to the attachment tabs 60 for bending the attachment tabs 60 in the direction in which they are more easily bendable. Conversely, the diverging sections 66 diverge significantly in the width direction in which the attachment tabs 60 can resist bending forces.

The invention has been described with respect to a preferred embodiment. However, various changes can be made without departing from the scope of the invention defined by the claims.

The number and the position of the attachment tabs 60 can be changed from the specific embodiment shown in the figures.

The connector 10 is illustrated as having a generally rectangular shape. However, the connector can have a non-rectangular shape.

The housing 12 does not require the seal hood 35. Thus the outer surface 46 of the fame shaped body 42 of the seal 40 can sealingly engage a mating housing.

What is claimed is:

1. A seal formed unitarily of an elastomeric material and comprising:

a frame-shaped body with opposite inner and outer peripheral surfaces defining a thickness and opposite front and rear surfaces;

a plurality of attachment tabs projecting rearward from the rear surface of the body, each of said attachment tabs having:

a neck with opposite front and rear ends defining a length, the front end of the neck being unitary with the rear surface of the body, the neck having a thickness measured parallel to the thickness of adjacent parts of the body and a width measured normal to the thickness of the neck, the width of the neck being greater than the thickness thereof; and a head having opposite front and rear ends defining a length greater than the length of the neck, a diverging section at the front end of the head and adjacent to the rear end of the neck, a holding section rearward of the diverging section and a converging section rearward of the holding section, the holding section defining a width greater than the width of the neck.

2. The seal of claim 1, wherein the length of the head is at least about twice as long as the length of the neck.

3. The seal of claim 1, wherein the thickness of the neck is less than the thickness of the body.

4. The seal of claim wherein the body is substantially rectangular and has two pairs of opposed sides, each side of the body has at least one attachment tab.

5. The seal of claim 1, wherein each of the attachment tabs is substantially symmetrical about a plane passing through the respective attachment tab in a direction parallel to the thickness.

6. The seal of claim 1, wherein the head has a maximum thickness approximately equal to the thickness of the neck.

7. The seal of claim 6, wherein the head has a minimum thickness less than the thickness of the neck.

8. A connector, comprising:

a housing with opposite front and rear ends and an outer peripheral surface extending between the ends, a flange projecting out from the outer peripheral surface at a location rearward of the front end of the housing, a plurality of mounting slots extending through the flange, each of said mounting slots having a height measured normal to an adjacent area of the outer peripheral surface and a width (d) measured normal to the height, the width being greater than the height; and an elastomeric seal having a frame-shaped body mounted on the outer peripheral surface of the housing between the front end of the housing and the flange, the body having a rear surface abutting the flange, attachment tabs projecting from the rear surface of the body, each said attachment tab having a neck in one of said mounting slots and a head rearward of the flange, the head having a thickness measured parallel to the height of the mounting slot and a width measured normal to the thickness, the width of the head being greater than the thickness of the head and portions of the head substantially adjacent the neck having a width greater than the width of the mounting slot, whereby the head engages a rear surface the flange for holding the seal on the housing.

9. The connector of claim 8, wherein the flange is spaced from the front end of the housing by a distance, the attachment tabs each having a projecting length at least equal to the distance.

10. The connector of claim 8, further comprising a seal hood projecting forward from the flange and spaced outward from the outer peripheral surface of the housing, the seal hood having an inner peripheral surface engaging an outer peripheral surface of the frame-shaped body of the seal.

11. The connector of claim 8, wherein the neck has a length extending from the frame-shaped body to the head, the head having a length extending rearward from the neck, the length of the head being greater than the length of the neck.

12. The connector (10) of claim 11, wherein the length of the head is at least about twice as long as the length of the neck.

13. The connector of claim 11, wherein rear portions of the head taper to smaller cross-sections than the mounting slots a diverging section at the front end of the head and adjacent to the rear end of the neck, a holding section rearward of the diverging section and a converging section rearward of the holding section, the holding section defining a width greater than the width of the neck.

14. The connector of claim 8, wherein the head has a maximum thickness approximately equal to a thickness of the neck.

15. The connector of claim 14, wherein the head has a minimum thickness less than the thickness of the neck.

16. A connector (10), comprising:

a housing with opposite front and rear ends and an outer peripheral surface extending between the ends, a flange projecting out from the outer peripheral surface at a location rearward of the front end of the housing by a distance, the flange having a selected thickness in a front-to-rear direction, a plurality of mounting openings extending through the flange in the front-to-rear direction; and an elastomeric seal having a frame-shaped body mounted on the outer peripheral surface of the housing between the front end of the housing and the flange, the body having a rear surface abutting the flange, attachment tabs projecting from the rear surface of the body, each said attachment tab having a neck in one of said mounting apertures and a head, the head joined unitarily with the neck at a location spaced rearwardly from the frame-shaped body by a distance substantially equal to the thickness of the flange, the front end of the head being cross-sectionally larger than the mounting aperture, the head further having a free rear end that is cross-sectionally smaller than the mounting aperture, the rear end of the head being spaced from the frame-shaped body (42) by a distance greater than the distance of the flange from the front end of the housing, whereby the head enters the mounting aperture before the frame-shaped body is mounted on the outer peripheral surface of the housing.

17. The connector of claim 16, wherein the heads have inwardly facing surfaces disposed so that the heads of the mounting tabs do not slide along the outer peripheral surface of the housing as the seal is being mounted on the housing.

18. The connector of claim 16, wherein the neck and the head each have lengths measured substantially normal to the rear surface of the frame-shaped body, the length of the head being at least twice as great as the length of the neck.

19. The connector of claim 18, wherein the neck and the head each have lengths measured substantially normal to the rear surface of the frame-shaped body, the length of the head being at least three times as great as the length of the neck.

* * * * *